United States Patent [19]

Battaglia

[11] Patent Number: 4,660,539

[45] Date of Patent: Apr. 28, 1987

[54] METHOD AND APPARATUS FOR CUTTING AND POLISHING MARBLE SLABS

[76] Inventor: Gino C. Battaglia, 20522 Vermont Ave., Harbor City, Calif. 90710

[21] Appl. No.: 841,153

[22] Filed: Mar. 19, 1986

Related U.S. Application Data

[63] Continuation-in-part of Ser. No. 741,254, Jun. 4, 1985, abandoned.

[51] Int. Cl.[4] ..... B28D 1/16

[52] U.S. Cl. ..... 125/10; 125/35

[58] Field of Search ..... 51/3 R, 5; 125/10, 13 R, 125/35; 144/3 R; 74/194

[56] References Cited

U.S. PATENT DOCUMENTS

| | | | |
|---|---|---|---|
| 1,007,540 | 10/1911 | Cross | 125/35 |
| 1,125,566 | 1/1915 | Lang | 125/35 |
| 1,491,287 | 4/1924 | Canning | 125/13 R |
| 1,493,519 | 5/1924 | Chase | 125/10 |
| 1,554,456 | 9/1925 | Morrill | 125/10 |
| 1,828,414 | 10/1931 | Illingworth et al. | 125/35 |
| 2,770,976 | 11/1956 | Frantz | 74/194 |
| 2,838,041 | 6/1958 | Rouis | 125/13 R |
| 3,164,144 | 1/1965 | Adams | 125/13 R |
| 3,292,310 | 12/1966 | LeFevre | 125/26 |
| 3,797,542 | 3/1974 | Wood | 144/3 R |

FOREIGN PATENT DOCUMENTS

| | | | |
|---|---|---|---|
| 330126 | 12/1920 | Fed. Rep. of Germany | 125/10 |
| 1944565 | 2/1978 | Fed. Rep. of Germany | 125/35 |

*Primary Examiner*—Harold D. Whitehead

*Attorney, Agent, or Firm*—Charles H. Thomas

[57] ABSTRACT

A machine is provided which automatically cuts and polishes disks of marble and finishes the edges of those disks. A marble cutting saw blade and a marble polishing wheel are disposed on a track located in spaced separation from a turntable. The turntable includes a central supporting pedestal and peripheral spacers which may be selectively located on a support to bear against the underside of a marble slab just within the diameter of a round disk which is to be cut therefrom. The sawing and polishing assemblies are mounted on separate carriages which move longitudinally along the track. The sawing and cutting assemblies can be adjusted vertically by means of separate, power driven drives. The speed of rotation of the turntable can be altered. An arbor is preferably located on the track between the two carriages to project toward the turntable. The arbor stabilizes the marble slab as it rotates with the turntable. Both the sawing and polishing assemblies are flushed with water to prevent chipping, suppress dust and increase the speed of cutting.

18 Claims, 8 Drawing Figures

METHOD AND APPARATUS FOR CUTTING AND POLISHING MARBLE SLABS

This is a continuation-in-part of U.S. patent application Ser. No. 741,254 filed on June 4, 1985 and now abandoned.

BACKGROUND OF THE INVENTION

1. Field of the Invention

The present invention relates to methods and machines for use in cutting and finishing disks of marble from marble slabs or sheets.

2. Desription of the Prior Art

In the past the manufacture of disks of marble for use as table tops, pedestals, sculpture bases, and for other decorative and structural purposes has largely been carried out by hand. To manufacture a disk of marble according to conventional techniques, a slab of marble is placed upon a central support with the edges of the slab overhanging the support. A pattern is first traced by hand with a template upon the marble slab to be cut. Frequently the pattern is a circle, since slabs of marble of disk-shaped configuration are required more frequently than slabs of any other configuration.

According to the conventional techniques, a workman proceeds to cut a disk of marble from the marble slab using a hand saw or a hand-held power saw to follow the circular pattern. Because marble is extremely hard, the procedure is very time consuming and tiring. As the workman tires the accuracy of conformity of cutting to the pattern often suffers. Furthermore, the pattern is frequently obscured by the dust produced from sawing, thereby making it even more difficult to follow the desired pattern.

Once a marble disk has been cut from a slab, the edges of the marble must be ground with a polisher to impart a glossy appearance to the edges which will match the appearance of the flat expansive surfaces of the marble slab. According to conventional practice, this task likewise is performed by hand. Again, a workman with a hand-held manually operated or power driven abrasive tool, such as an electric sander, must manually sand the cut edges of the marble disk. This procedure is extremely labor intensive, time consuming, and therefore expensive. Furthermore, worker fatigue in finishing the edges of the cut marble slab sometimes results in only a mediocre finish on the cut marble edges.

SUMMARY OF THE INVENTION

In one broad aspect the present invention may be considered to be a new and improved method of manufacture. The method involves an automated procedure for cutting and polishing marble slabs for decorative and structural purposes. According to the invention an unfinished marble slab is mounted upon a turntable for rotation about a turntable axis. To facilitate handling and maximize stability the turntable axis is normally vertical, so that the turntable rotates in a horizontal plane. The turntable has a flat, disk-shaped support with a center pedestal thereon. The turntable also includes a plurality of locator apertures therethrough which are arranged in radial rays and in concentric circular rings about the center pedestal. A plurality of peripheral spacers are provided having bodies the same height as the center pedestal. The peripheral spacers also have locator pins which fit into the locator apertures in the disk-shaped support.

According to the invention, one of the rings of locator apertures in the support is selected. The ring selected is of a diameter which is closest to, and less than a desired diameter of cutting of a marble slab. The ring of locator apertures selected must also be of a small enough diameter so that the saw blade will clear the bodies of the peripheral spacers. The peripheral spacers are then placed on the support with the locator pins thereof depending into the locator apertures of the selected ring to hold the peripheral spacers in position on the surface of the disk-shaped support. The unfinished marble slab is then placed upon the turntable and is supported from beneath by the center pedestal and the peripheral spacers. The bodies of the peripheral spacers support the marble slab just within the diameter of a round disk to be cut from the marble slab.

A saw blade and a saw motor are mounted on a first carriage so that the saw blade is roatable about a blade axis perpendicular to the turntable axis. The first carriage is moved along a track that extends parallel to the turntable at a spaced separation therefrom. The saw blade is thereby positioned at a selected distance from the turntable axis on one side of the axis. The turntable and the saw blade are then rotated concurrently so that the saw blade cuts the slab along a circular pattern, leaving a round disk of the desired diameter supported from beneath by the center pedestal and the peripheral spacers.

A polishing wheel and a polishing motor are mounted on a second carriage so that the polishing wheel is rotatable about a polishing wheel axis which is also perpendicular to the turntable axis. The second carriage is moved along the track to position the polishing wheel at the same selected distance from the turntable axis as the saw blade, but on the opposite side of the turntable axis therefrom. The turntable and the polishing wheel are then rotated concurrently so that the polishing wheel finishes the edge of the round disk previously cut by the saw blade. At the same time the polishing wheel is resiliently biased toward the edge of the round disk. A compressible, coil spring may be used for this support and disposed coaxially about the shaft which turns the polishing wheel. The spring bears against an annular bearing on the back of the polishing wheel and against the polishing wheel motor or motor support.

In another broad aspect the invention may be considered to be a machine for cutting and polishing slabs of marble. The machine has a turntable. The turntable is comprised of a flat, rigid disk shaped support having a center pedestal thereon. A plurality of locator apertures are defined through the support and are arranged in concentric circular rings about the center pedestal. A plurality of peripheral spacers having bodies the same height as the center pedestal are also provided. The peripheral spacers also have locator pins which are adapted to fit into any selected locator aperture. In this way, the center pedestal supports the center and the peripheral supports support the periphery of the marble slab positioned thereon and which is to be cut and polished.

Some means forming a track is located in spaced separation from the turntable to extend longitudinally parallel to the slab. A first carriage rides upon the track and a saw motor is mounted upon the first carriage. A saw blade driven in rotation by the saw motor is carried by the first carriage in a plane which intersects the marble slab. A first, power operated, vertical drive means is provided for automatically raising and lowering the saw blade relative to the turntable.

The machine also has a second carriage which rides upon the track. A polishing motor is mounted upon the second carriage and a polisher driven by the polishing motor is carried by the second carriage to bear against the transverse edges of the cut marble slab. A compressible spring biasing means is interposed between the polisher and the polisher motor to urge the polisher toward the cut marble slab. A second power operated vertical drive means is provided for automatically raising and lowering the polisher and polisher motor relative to the turntable. The system includes a slab rotating means for rotating the marble slab about an axis perpendicular to the track.

Preferably, the polisher is of an annular configuration with a concave center. The axis of rotation of the polisher is perpendicular to the axis of rotation of the turntable. The annular rim of the polisher is oriented in a generally vertical disposition, and the lower edge of the annular rim presses against the cut marble slab. The concave center of the polisher is therefore located above the marble slab. A water line is disposed and connected so as to direct a stream of water into the convex center of the polisher. This allows water to stay on the stone slab better. Flushing with water suppresses chipping and dust and increases the speed with which the edge of the slab can be polished. Preferably also, another water line is connected to direct a stream of water at the saw blade where the saw blade cuts the marble slab.

An arbor is preferably mounted upon the track between first and second carriages to project toward the turntable coaxially along the axis of rotation of the marble slab. The purpose of the arbor is to stabilize the marble slab against the turntable as it rotates, so that the slab will not shift laterally during rotation.

The system is also preferably provided with some means for adjusting the speed of rotation of the slab rotating means. Marble slabs of a greater thickness must be rotated more slowly than thinner slabs, since in forming thicker marble disks the saw blade and polishing wheel must dwell at each location along the perimeter of the marble disk for a greater period of time.

The use of a power driven vertical drive in connection with the saw assembly mounting means allows the saw motor and the saw blade to be automatically moved together in transversely reciprocal fashion perpendicular to the orientation of the track. This allows slabs of a considerble thickness to be cut, since the saw blade can be progressively lowered to increasingly score the surface of the marble slab facing the track, each time the slab is rotated through a complete circle. Likewise, the polisher assembly mounting means is preferably provided with a power driven vertical drive so that the polishing motor and the polisher can be moved together upon the second carriage in transversely reciprocal fashion perpendicular to the track. The polisher assembly can likewise be advanced in a vertical direction and lengthwise along the cylindrical cut edge of the marble disk formed by the saw blade.

The invention may be defined with greater clarity and particularity by reference to the accompanying drawings.

DESCRIPTION OF THE EMBODIMENT AND IMPLEMENTATION OF THE METHOD OF THE INVENTION

Figure 2:
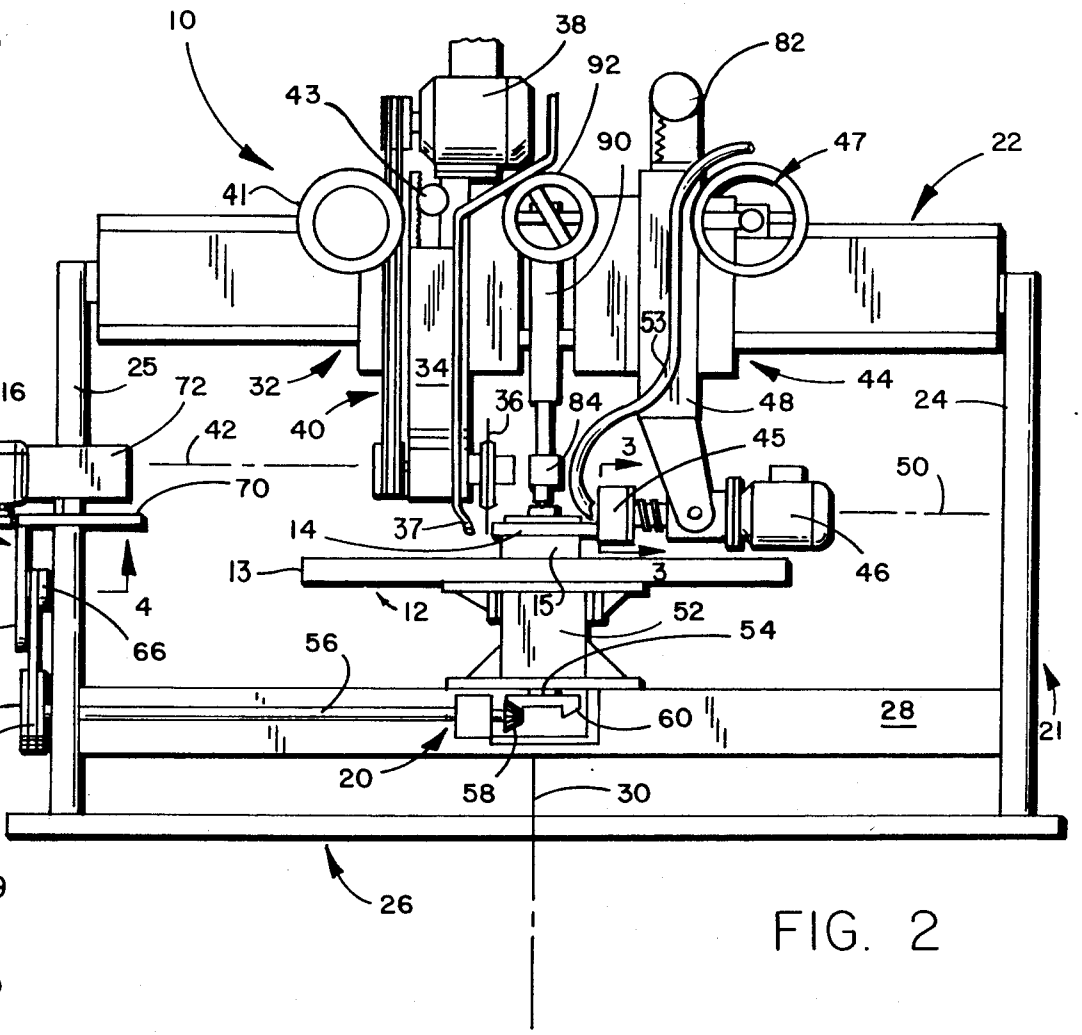
FIG. 2 is a side elevational view of the automatic marble slab finishing machine of FIG. 1.
Figure 1:
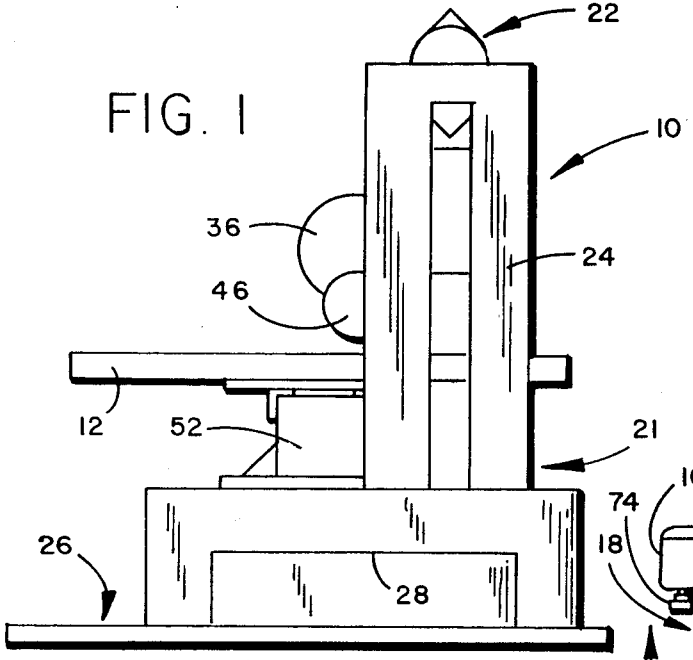
FIG. 1 is a sectional elevational end view of an automatic marble slab finishing machine according to the invention.

An automatic marble slab finishing machine 10 is depicted in FIGS. 1 and 2. The machine 10 has a disk-shaped, rotatable turntable 12 adapted to carry a marble slab to be cut and polished. A marble slab 14 is depicted in position on the turntable 12 in FIG. 2.

Figure 6:
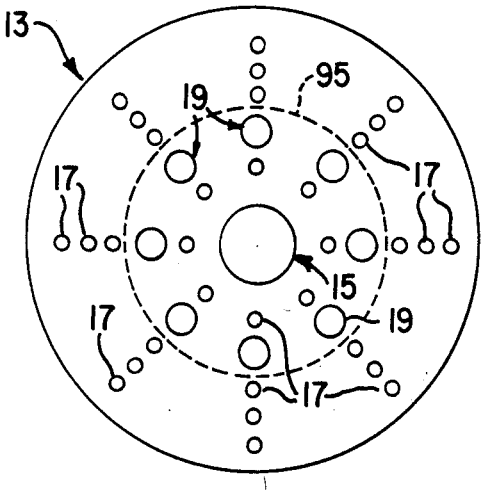
FIG. 6 is a top plan view of the disk-shaped support of the turntable.
Figure 7:
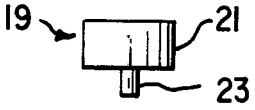
FIG. 7 is an isolated elevational view of a single peripheral spacer used with the support of FIG. 6.

The turntable 12 is comprised of a flat, rigid disk shaped steel slab which serves as a support 13 and which is depicted in the plan view of FIG. 6. At the axis of rotation of the support 13 there is a raised, disk shaped pedestal 15 approximately six inches in diameter and two inches in height. The support 13 has a plurality of locator apertures 17 defined entirely therethrough. The locator apertures 17 are arranged in concentric circular rings or patterns about the center pedestal 15 and along eight radial rays which converge at the center pedestal 15. A plurality of peripheral spacers 19 are provided having cylindrical bodies 21 of the same height as the center pedestal. The bodies 21 are disk shaped and are about three inches in diameter. The peripheral spacers 19 each have a locator pin 23 which is coaxial with the body 21 and extends downwardly therefrom. The locator pins 23 of the peripheral spacers 19 are adapted to fit into any selected locator aperture 17 in the support 13. In this way the center pedestal 15 supports the center of the marble slab 14 and the peripheral supports 19 support the periphery thereof, as depicted in detail in FIG. 8.

A motor 16 drives the turntable 12 in rotation though a speed adjusting mechanism 18, hereinafter to be described, and through a shaft and gearing system indicated generally at 20 in FIG. 2 The speed adjusting mechanism 18 and the shaft and gearing system 20 reduce the rotational speed of the turntable 12 to only a small fraction of the speed of the motor 16. The axis of rotation of the turntable 12 is indicated at 30 in FIG. 2. The turntable axis 30 is vertical, so that the turntable 12 and the marble slab 14 are carried in a horizontal disposition.

The machine 10 is constructed with a heavy steel frame 21 which supports the turntable 12. The frame 21 includes a track 22 which is disposed parallel to the turntable 12 in a horizontal disposition vertically above the turntable 12. The track 22 is supported in position by upright stanchions 24 and 25 at opposite ends of the machine 10. The stanchions 24 and 25 rise from a base 26 of the frame 21 which is located beneath the turntable 12, and are stabilized relative to each other by a horizontal mounting platform 28 which has clearance beneath for the shaft and gearing system 20.

The track 22, the upright stanchions 24 and 25, the mounting platform 28, and the base 26 together form the framework 21 upon which the other components of the machine 10 are mounted. All of the elements of the framework are constructed of heavy steel, so as to withstand the large forces which are necessary to properly machine marble slabs, such as the marble slab indicated at 14.

A first carriage 32 is mounted for longitudinal reciprocal movement along the track 22. The carriage 32 includes a saw assembly mounting arm 34 which is oriented perpendicualr to the track 22 and extends toward the turntable 12. The saw assembly mounting arm 34 carries a disk-shaped saw blade 36 in a plane perpendicular to the orientation of the turntable 12. The saw blade 36 is typically constructed of carborundum, or some other material conventionally used to cut marble. A water line 37 is connected to a source of water under pressure (not shown) to direct a stream of water at the saw blade 36 where it cuts into the marble slab 14. The stream of water suppresses chipping and dust and increases the speed of cutting. A 7.5 horsepower saw motor 38 is provided for driving the saw blade 36 through a belt drive system indicated at 40. The axis of rotation of the saw blade is indicated at 42 in FIG. 2, and is perpendicular to the turntable axis 30. With the system depicted, a marble disk three feet in diameter can be cut from a marble slab in from about five to about seven minutes.

The carriage 32 is moved longitudinally along the track 22 by means of a hand wheel 41. The hand wheel 41 turns a pinion to drive the carriage 32 along a rack on the track 22, so that the carriage 32 is moved along the track by conventional rack and pinion gearing.

A second carriage 44 is also mounted for longitudinal reciprocal movement along the track 22 and includes a polishing assembly mounting arm 48. The polishing assembly mounting arm 48 extends toward the turntable 12 and carries a 2 horsepower polishing motor 46 and a polishing wheel 45 that also rotates about an axis perpendicular to the turntable axis 30. The polishing wheel axis is indicated at 50 in FIG. 2.

Figure 3:
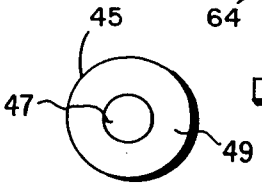
FIG. 3 is an elevational detail of the polishing wheel taken along the lines 3—3 in FIG. 2.
Figure 5:
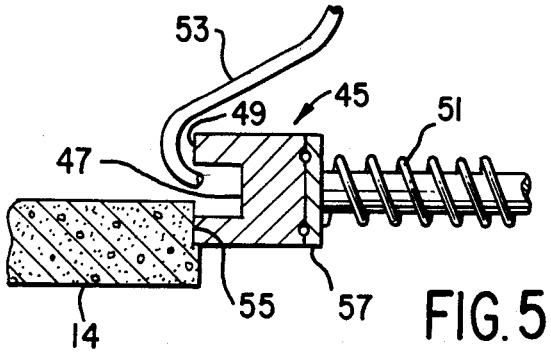
FIG. 5 is an elevational, cross-sectional detail illustrating the operation of the polisher.

The polishing wheel 45 is depicted in cross section in FIGS. 3 and 5 and is of a generally cup-shaped configuration with a concave center formed as a central, axial depression 47 and an annular rim 49 that serves as the polishing or grinding surface and is formed of abrasive material. As polishing proceeds, the polishing wheel 45 is changed from a rather coarse stone abrasive material to a polishing wheel of finer abrasive characteristics. Usually, three different grinding wheels are employed to produce the finished marble disk. As illustrated in FIG. 5, a resilient, compressible coil spring 51 is located behind the polished wheel 45 to push the polishing wheel toward the marble slab 14. The second carriage 44 is positioned so that the spring 51 is slightly compressed between an annular bearing 57 at the backside of the polishing wheel 45 and the polishing motor 46 or a polishing motor support. When the polishing wheel 45 is positioned in this fashion, constant repositioning of the second carriage 44 along the track 22 is unnecessary as the grinding face 49 of the polishing wheel 45 is worn down. Rather, the spring 51 ensures that sufficient friction exists against the edge of the marble slab 14, even as the grinding face 49 is worn away. The polishing wheel shaft 59 is driven by the polisher motor 46 through a splined connection, so that the shaft 59 can move reciprocally to some extent.

The annular grinding face 49 of the polishing wheel 45 is depicted in FIG. 3. Another water line 53 is connected to a source of water under pressure (not shown) to direct a stream of water into the concave center 47 of the polishing wheel 45, as best depicted in FIG. 5. Because the polishing wheel 45 is formed with a central, axial depression 47, water tends to dwell therein and is supplied steadily to the grinding interface 55 at which the polishing wheel 45 contacts the marble slab 14. Flushing the grinding interface 55 copiously with water reduces heat, suppresses chipping and airborne dust and increases the speed with which edge of the marble slab 14 can be polished.

The second carriage 44 is also moved along the track 22 by conventional rack and pinion gearing under the control of a hand wheel 47. To protect the rack and pinion gearing from marble dust and chips, and to thereby produce longer life and improve smoothness of operation, all of the working components of the rack and pinion gearing of both the first carriage 32 and the second carriage 44 are enclosed and shielded.

An annular, upright drum-like pedestal 52 is mounted atop the platform 28 at the center of the framework 21. The turntable 12 is supported on bearings and is driven in rotation by an upright, vertical drive shaft 54. Power is transmitted to the drive shaft 54 through a horizontal elongated shaft 56 to a bevel gear pinion 58. The pinion 58 turns a much larger bevel ring gear 60 that is rigidly secured to the drive shaft 54. The elongated shaft 56, in turn, is driven by a large pulley 62, located outside of the frame 21 beyond the stanchion 25. The pulley 62, in turn, is driven by a belt 64 from a much smaller pulley 66. The pulley 66 is driven by a large, rubber tired power take-off wheel 68, depicted in FIGS. 2 and 4.

Figure 4:
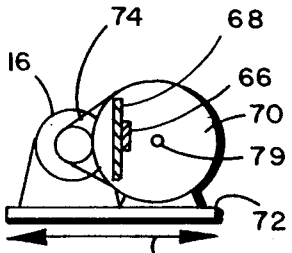
FIG. 4 is an elevational detail of the turntable speed adjustment mechanism taken along the line 4—4 in FIG. 2.

The power take-off wheel 68 is oriented perpendicular to a power transfer disk 70, which is journaled for rotation in a mounting supported upon a vertical plate which forms a mounting bracket 72 that is reciprocably moveable relative to the stanchion 25 in the directions indicated by the directional arrows 78 in FIG. 4. The turntable drive motor 16 is also mounted upon the support bracket 72 and is coupled to drive the power transfer disk 70 by means of a V-belt 74, as best depicted in FIG. 4.

Since the turntable drive motor 16 and the power transfer disk 70 can be shifted together as indicated by the directional arrows 78, the distance from the axis of rotation 79 of the power transfer disk 70 at which the power take-off wheel 68 rides is adjustable. In FIG. 2, the power take-off wheel 68 is shown as riding near the periphery of the power transfer disk 70. As a result, the angular speed of rotation of the power take-off wheel 68 is relatively great. If the turntable drive motor 16 and power transfer disk 70 are shifted to the left, as viewed in FIG. 4, the power take-off wheel 68 will ride on the surface of the power transfer disk 70 much closer to the axis of rotation 79 of the power transfer disc 70. The rotational speed of the power take-off wheel 68 will thereupon be significantly reduced. This speed reduction in turn reduces the speed of rotation of the bevel pinion 58 and bevel ring gear 60. The speed of rotation of the turntable 12 is thereupon reduced.

It can thus be seen that one may adjust the speed of rotation of the turntable 12 by shifting the mounting bracket 72 to adjust the positon of the turntable drive motor 16 and the power transfer disk 70 in reciprocal fashion, as indicated by the directional arrows 78 in FIG. 4. The speed of rotation of the turntable 12 will be directly proportional to the magnitude of the distance from the axis of rotation 79 of the power transfer disk 70 at which the power take-off wheel 68 rides in contact with the surface of the power transfer disk 70. To reduce speed the turntable drive motor 16 and power transfer disk 70 are moved to the left as viewed in FIG. 4. To increase the speed of rotation of the power take-off wheel 68, the turntable drive motor 16 and power transfer disk 70 are moved to the right as viewed in FIG. 4. At maximum turntable speed the power transfer disk 70 and the turntable drive motor 16 are at approximately the position depicted in FIG. 2.

In the preferred embodiment of the invention the saw motor 38 and the saw blade 36 are both mounted upon the saw assembly mounting arm 34. The saw assembly mounting arm 34 is coupled to move upon the first carriage 32 in transversely reciprocal fashion perpendicular to the track 22. The saw motor 38 is rigidly secured to the saw assembly mounting arm 34, while the saw blade 36 is mounted upon an axle which is journaled to rotate within bearings in the saw assembly mounting arm 34. The saw motor 38 thereby drives the saw blade 36 in rotaiton about the saw blade axis 42 through V-belts 40 of fixed length. The saw motor 38, the saw blade 36, and the saw arm 34 are moveable in reciprocation together relative to the first carriage 32, perpendicular to the track 22 and parallel to the turntable axis 30.

The saw assembly mounting arm 34 is moved in reciprocation by a first power operated drive means in the form of a stepper motor 43. The stepper motor 43 is electrically operated and has a pinion which is mounted in a vertical plane and rotates about a horizontal axis. The pinion is engaged with a vertically oriented rack which extends the length of the saw assembly mounting arm 34. Rotation of the stepper motor pinion in one direction will drive the saw assembly mounting arm 34 vertically upwardly to lift the saw blade 36 relative to the turntable 12. When the stopper motor pinion is rotated in the opposite direction the saw blade 36 is lowered closer to the turntable 12. Control of the stepper motor 43 is preferably performed from a remote electrical switch box.

In the same manner the polishing assembly mounting arm 48 can be moved vertically upwardly and downwardly by means of a corresponding second power operated vertical drive means such as the stepper motor 82. The stepper motor 82 automatically raises and lowers the polishing wheel 45 and the polishing wheel motor 46 relative to the turntable. The stepper motor 82 likewise employs a rack and pinion mechanism like the stepper motor 43. Control of the stepper motor 82 is also performed from a remote electrical switch box. The stepper motor 82 is used to move the polishing assembly mounting arm 48 in transversely reciprocal fashion relative to the second carriage 44 and perpendicular to the track 22 and parallel to the turntable axis of rotation 30 by means of conventional rack and pinion gearing.

Figure 8:
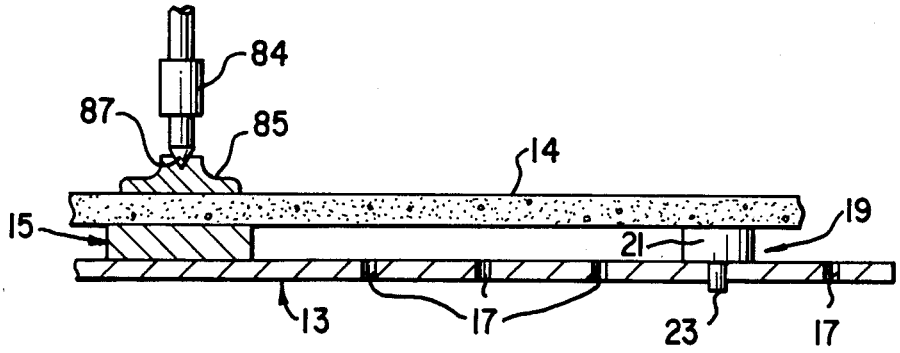
FIG. 8 is a partial, sectional, elevational detail showing a marble slab supported on the turntable of the machine of FIG. 2.

The machine 10 is also equipped with an arbor 84 which has a downwardly directly turning tip 87. The turning tip 87 may be moved vertically downwardly to bear against the marble slab 14 through a conventional pressure pad 85, which has a conical indentation to seat the turning tip 87 of the arbor 84 as depicted in FIG. 8. The arbor 84 is carried telescopically within an arbor sleeve 90, as illustrated in FIG. 2. The arbor 84 may be moved in vertically reciprocal fashion by means of conventional rack and pinion gearing under the control of a hand wheel 92. The arbor 84 is mounted on the track 22 by means of the arbor arm 90 between the first and second carriages 32 and 44. The arbor 84 projects toward the mounting base 52 coaxially along the axis of rotation 30 of the marble slab 14 and the turntable 12 to stabilize the marble slab 14 as it rotates.

The unique design of the turntable 13 provides great flexibility, versitility and efficiency in cutting and polishing marble disks from marble slabs. As previously noted, it is highly desirable for the peripheral spacers 19 to be located at locator apertures 17 closest to and just within the desired diameter of cutting of a marble slab. That is, for example, if a marble slab is to have a diameter 95, depicted in phantom in FIG. 6, the peripheral spacers 19 should be located just within the diameter 95, as depicted in FIG. 6. The saw blade 36 will thereby pass in a circular path just outside of the bodies 21 of the peripheral spacers 19. The peripheral spacers 19 are thereby able to provide solid support to the periphery of the marble disk to be cut. This stabilizes the marble slab 14 at the most important location, which is the line of cutting.

The turntable 12 may be utilized with virtually any diameter of marble disk to be cut. When a marble disk of a different size is to be cut, the peripheral spacers 19 are merely lifted from the support 13 to disengage the locator pins 23 from the locator apertures 17. The desired concentric ring of locator apertures 17 is then selected, and the peripheral spacers 19 are then each engaged in one of the locator apertures 17 in the selected ring of apertures by simply inserting the locator pin 23 thereof in a selected locator aperture 17.

The unique design of the turntable 12 allows virtually any different size of marble disk to be efficiently supporting during the cutting and grinding operation. Solid support at the periphery of the marble disk increases the speed of cutting, as well as the finish which is obtained in both cutting and polishing. Thus, the unique turntable 12 provides the marble cutting machine of the invention with greatly improved versatility and efficiency.

In the operation of the machine 10 according to the method of the invention, the saw assembly mounting arm 34, the arbor 84 and the polishing assembly mounting arm 48 are all withdrawn vertically upwardly and away from the turntable 12. An uncut marble slab 14 is then positioned atop the turntable 12. The perimeter of the marble slab 14 is typically of irregualar shape, but the slab 14 is centered insofar as possible upon the axis of rotation 30 atop the turntable 12, to minimize waste. The hand wheel 92 is then turned to drive the arbor 84 vertically downwardly within the arbor sleeve 90 so that the arbor 84 bears against the marble slab 14 through the turning tip 87 and the pressure pad 85. The turning tip 87 is coaxially aligned with the turntable axis 30.

The first carriage 32 is then moved along the track 22 parallel to the turntable 12 at a spaced separation therefrom by means of the hand wheel 41 to position the saw blade 36 at a selected distance from the turntable axis 30 on one side thereof. The distance is determined by the radius of the marble disk to be produced. The position of the saw assembly arm 34 is then vertically adjusted by the stepper motor 43 to bring the saw blade 36 into contact with the marble slab 14. The saw blade 36 and the turntable 12 are thereupon concurrently rotated. As sawing commences, the saw assembly arm 34 is moved vertically downwardly by means of the stepper motor 43 so that the saw blade 36 cuts into the marble slab 14. The saw blade 36 is rotated at a much higher speed than the turntable 12. After the turntable 12 has rotated through a number of circular revolutions and the saw blade 36 has trimmed the irregular edges from the marble slab 14, a marble disk is left. The peripheral spacers 19 provide solid support to the marble slab 14 proximate to the path of cutting during the cutting operation. The stepper motor 43 may thereupon be operated to withdraw the first carriage 32 away from the marble slab 14 so as to avoid interference in the polishing operation from the saw blade 36.

The second carriage 44 is then moved along the track 22 by means of the hand wheel 47 to position the polishing wheel 45 at the same selected distance from the turntable axis 30 as the saw blade 36 was previously positioned with the spring 51 compressed. The polishing wheel 45 is located on the side of the turntable axis 30 opposite the saw blade 36 so that the movements of the carriages 32 and 44 do not bring the saw blade 36 and the polishing wheel 45 into interference with each other. The stepper motor 82 is used to vertically adjust the position of the polishing wheel 45 relative to the cut edge of the marble slab 14. The polishing wheel 45 should be located as depicted in FIG. 5, with the lower edge of the polishing face 49 in contact with the edge of the marble slab 14 to be polished. This allows a stream of water to be supplied through the water line 53 into the concave center 47 of the polishing wheel 45. By supplying a stream of water to this cup-shaped depression, a greatly enhanced flushing effect is achieved. This results in a smoother finish, increased speed of polishing and a suppression of dust and chipping.

The turntable 12 and the polishing wheel 45 are then concurrently rotated so that the polishing wheel 45 finishes the edge of the round marble disk left from the slab 14. The coil spring 51 ensures that the polishing face 49 of the polishing wheel 45 maintains contact with the edge of the marble slab 14. The polishing wheel 45 is driven at a much greater angular speed than the turntable 12. When the cylindrical peripheral edge of the marble disk has been satisfactorily finished, the hand wheel 47 is operated to laterally move the second carriage 44 to withdraw the polishing wheel 45 from the marble disk created from the marble slab 14. The hand wheel 92 is then operated to withdraw the arbor 84 vertically upward, and the finished marble disk is removed from the turntable 12.

Depending upon the thickness of the marble slab 14, and the speed of rotation of the saw blade 36 and the polishing wheel 45, an adjustment in turntable speed may be desirable. Adjustment of the speed of rotation of the turntable 12 on the turntable axis 30 is achieved in the manner previously described. That is, the mounting bracket 72 carrying the turntable drive motor 16 and power transfer disk 70, is shifted to the left, as viewed in FIG. 4, to reduce the speed of rotation of the turntable 12. To increase the speed of turntable rotation, the mounting bracket 72 is shifted to the right as viewed in those drawing figures.

Undoubtedly, numerous variations and modifications of the invention will become readily apparent to those skilled in the art of manufacturing marble disks from marble slabs. For example, other conventional mechanical linkages may be substituted for the rack and pinion gearing, the telescoping mechanism, and the drive shaft and gearing employed in the embodiment of the machine of the invention depicted in the drawings. Accordingly, the scope of the invention should not be construed as limited to the specific embodiment and implementation of method described herein, but rather is defined in the claims appended hereto.

I claim:

1. A machine for cutting and polishing slabs of marble comprising:

a turntable comprising a flat, rigid, disk shaped support having a center pedestal thereon, and a plurality of locator apertures through said support which are arranged in concentric circular rings about said center pedestal, and a plurality of peripheral spacers having bodies the same height as said center pedestal and locator pins adapted to fit into any selected locator aperture, whereby said center pedestal supports the center and said peripheral supports support the periphery of a marble slab positioned thereatop to be cut and polished, track means located in spaced separation from said turntable and extending longitudinally parallel to said slab, a first carriage which rides upon said track means, a saw motor mounted upon said first carriage, a saw blade driven in rotation by said saw motor and, carried in a plane which intersects said marble slab, first power operated vertical drive means for atuomatically raising and lowering said saw blade relative to said turntable, a second carriage which rides upon said track means, a polisher motor mounted upon said second carriage, a polisher driven by said polisher motor and carried to bear against transverse edges of said marble slab, and including compressible spring biasing means interposed, between said polisher and said polisher motor to urge said polisher toward said marble slab, second power operated vertical drive means for automatically raising and lowering said polisher and polisher motor relative to said turntable, slab rotating means for rotating said marble slab about an axis perpendicular to said track means.

2. A machine according to claim 1 further comprising a mounting base, frame which supports said turntable and supports said track means above said mounting base, and further comprising an arbor mounted upon said track means between said first and second carriages and projecting toward said turntable coaxially with said axis of rotation of said marble slab to stabilize said marble slab as it rotates.

3. A machine according to claim 2 further comprising means for adjusting the speed of rotation of said slab rotating means.

4. A machine according to claim 3 in which said means for adjusting speed of rotation includes:

motor means driving a power transfer disk in rotation at a uniform speed, a power take-off wheel oriented perpendicular to said power transfer disk and riding in contact therewith, means for moving said power take-off wheel across the surface of said power transfer disk to vary the distance from the axis of rotation of said power transfer disk at which said power take-off wheel contacts said power transfer disk, and power transmission means coupling said power take-off wheel to said marble slab.

5. A machine according to claim 1 comprising water lines connected to direct streams of water at both said saw blade and said polisher.

6. A machine according to claim 1 in which said polisher is of annular configurigation with a concave center, and one of said water lines directs a stream of water into said concave center of said polisher.

7. An automatic marble slab finishing machine comprising:

a rotatable turntable comprising a flat, rigid, disk shaped support having a center pedestal thereon, and a plurality of locator apertures therethrough, which are arranged in concentric circular paterns about said center pedestal, and a plurality of peripheral spacers having bodies of the same height as said center pedestal and locator pins adapted to fit into any selected locator aperture, whereby said center pedestal supports the center and said perhipheral supports support the periphery of a marble slab to be cut and polished, means for driving said turntable in rotation about a turntable axis, a track means disposed parallel to said turntable and extending perpendicular to said turntable axis a spaced distance from said turntable, a first carriage mounted for longitudinal reciprocal movement along said track means and including an arm extending toward said turntable and carrying a saw blade perpendicular to the orientation of said turntable, and a saw motor for driving said saw blade in rotation on one side of said turntable axis, a second carriage mounted for longitudinal reciprocal movement along said track means and including a polisher motor and a polisher arm extending toward said turntable and carrying a polisher driven by said polisher motor for rotation about an axis perpendicular to said turntable axis.

8. A machine according to claim 7 further comprising power operated means for automatically moving said saw blade and said saw motor together perpendicular to the orientation of said track means.

9. A machine according to claim 7 further comprising means for automatically moving said polisher arm perpendicular to the orientation of said track means.

10. A machine according to claim 7 further comprising an arbor mounted upon said track means between said first and second carriages and projecting toward said turntable coaxially along said turntable axis to stabilize said marble slab on said turntable.

11. A machine according to claim 10 further comprising arbor adjusting means interposed between said track means and said arbor or adjusting the position of said arbor along said turntable axis.

12. A machine according to claim 7 further comprising means for selectively varying the speed of rotation of said turntable.

13. A method of cutting and polishing marble slabs using a turntable having a flat, disk shaped support with a center pedestal thereon, and a plurality of locator apertures therethrough which are arranged in concentric circular rings about said center pedestal, and a plurality of peripheral spacers having bodies the same height as said center pedestal and locator pins which fit into said locator apertures, comprising selecting one of said rings of locator apertures which is of a diameter closest to and less than a desired diameter of cutting of a marble slab, placing said locator pins of said peripheral spacers into said locator apertures of said selected ring of apertures, mounting an unfinished marble slab on a turntable for rotation about a turntable axis, so that said center pedestal supports the center thereof and so that said peripheral spacers support the periphery thereof proximate to and within a circular pattern to be cut, mounting a saw blade and a saw motor on a first carriage so that said saw blade is rotatable about a blade axis perpendicular to said turntable axis, moving said first carriage along a track extending parallel to said turntable at a spaced separation therefrom to position said saw blade at a selected distance from said turntable axis on one side thereof, concurrently rotating said turntable and said saw blade so that said saw blade cuts said slab along a circular pattern into a round disk of said desired diameter, mounting a polishing wheel and a polishing motor on a second carriage so that said polishing wheel is rotatable about a polishing wheel axis which is also perpendicular to said turntable axis, moving said second carriage along said track to position said polishing wheel at said same selected distance from said turntable axis and opposite said saw blade, concurrently rotating said turntable and said polishing wheel and resiliently biasing said polishing wheel toward said edge of said round disk so that said polishing wheel finishes the edge of said round disk.

14. A method according to claim 13 further comprising using power operated vertical drive means for adjusting the position of said saw blade and said polishing wheel in a direction perpendicular to said track in accordance with the thickness of said marble slab.

15. A method according to claim 13 further comprising adjusting the speed of rotation of said turntable in accordance with the thickness of said marble slab.

16. A method according to claim 13 further characterized in that said polishing wheel is of cup-shaped configuration having an annular rim for bearing against said round disk, and defining a concave center further comprising resiliently biasing said polishing wheel toward said round disk.

17. A method according to claim 16 further comprising flushing said polishing wheel by directing a stream of water at said concave center thereof.

18. A method according to claim 17 further comprising directing a stream of water at said saw blade where it cuts said slab.

* * * * *